US008142149B2

(12) United States Patent
Sun

(10) Patent No.: US 8,142,149 B2
(45) Date of Patent: Mar. 27, 2012

(54) FAN DEVICE AND FAN DEVICE ASSEMBLY

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 645 days.

(21) Appl. No.: 12/346,861

(22) Filed: Dec. 31, 2008

(65) Prior Publication Data

US 2010/0104434 A1 Apr. 29, 2010

(30) Foreign Application Priority Data

Oct. 29, 2008 (CN) ..... 2008 1 0305269

(51) Int. Cl.
*F01D 25/28* (2006.01)

(52) U.S. Cl. ..... 415/213.1; 415/214.1

(58) Field of Classification Search ..... 415/213.1, 415/200, 121.2, 214.1, 229, 220, 216.1, 203, 415/213; 416/244 R, 247 R; 417/423.14
See application file for complete search history.

(56) References Cited

U.S. PATENT DOCUMENTS

| | | | | |
|---|---|---|---|---|
| 6,549,406 | B1 * | 4/2003 | Olesiewicz et al. | 361/695 |
| 7,826,224 | B2 * | 11/2010 | Sun | 361/697 |
| 2002/0098086 | A1 * | 7/2002 | Orlowski et al. | 415/213.1 |
| 2003/0035724 | A1 * | 2/2003 | Chen et al. | 415/213.1 |
| 2004/0202541 | A1 * | 10/2004 | Stewart et al. | 415/213.1 |
| 2004/0257767 | A1 * | 12/2004 | Wang | 361/695 |
| 2007/0146991 | A1 * | 6/2007 | Chen et al. | 361/695 |

FOREIGN PATENT DOCUMENTS

CN 2472459 Y 1/2002

* cited by examiner

*Primary Examiner* — Caridad Everhart
(74) *Attorney, Agent, or Firm* — Altis Law Group, Inc.

(57) ABSTRACT

A fan device for easily being attached to a fixing plate includes a pair of sliding slots symmetrically defined in two opposite sides thereof, and at least one positioning block extending from at least one of the bottom and the top of the fan device and located close to one same side of the fan device.

12 Claims, 5 Drawing Sheets

FAN DEVICE AND FAN DEVICE ASSEMBLY

BACKGROUND

1. Technical Field

The present disclosure relates to heat-dissipating components and, particularly, to a fan device and fan device assembly.

2. Description of Related Art

In a typical computer system, a plurality of fans are secured by screws or the like to an enclosure of the computer system and is used for producing a flow of cooling air over certain electrical components within the enclosure, dissipating heat generated by the closely spaced electrical components so that the components operate within a desired temperature range. However, as computer systems become smaller in size, the components become more tightly arranged within the enclosure of the computer system. When the fans are secured to and/or removed from the enclosure, use of a tool for installing and/or removing screws may cause damage to the components, as there is no enough space for the tool to maneuver within the enclosure of the computer system. In addition, the installation or removal of the screws is time consuming and troublesome.

DETAILED DESCRIPTION

Figure 1:
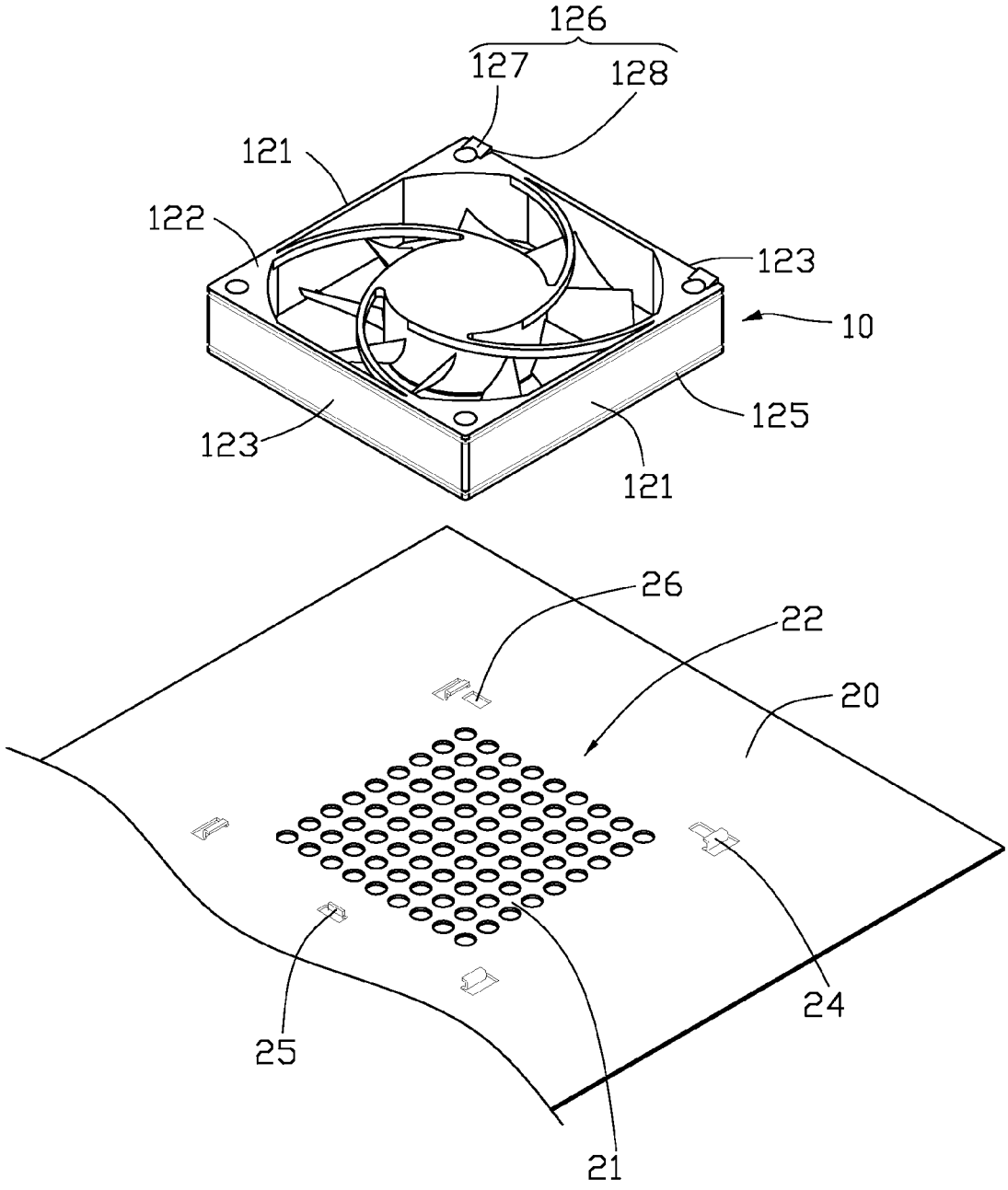
FIGS. 1 and 2 are exploded, isometric views of a first embodiment of a fan device assembly, viewed from different aspects.
Figure 2:
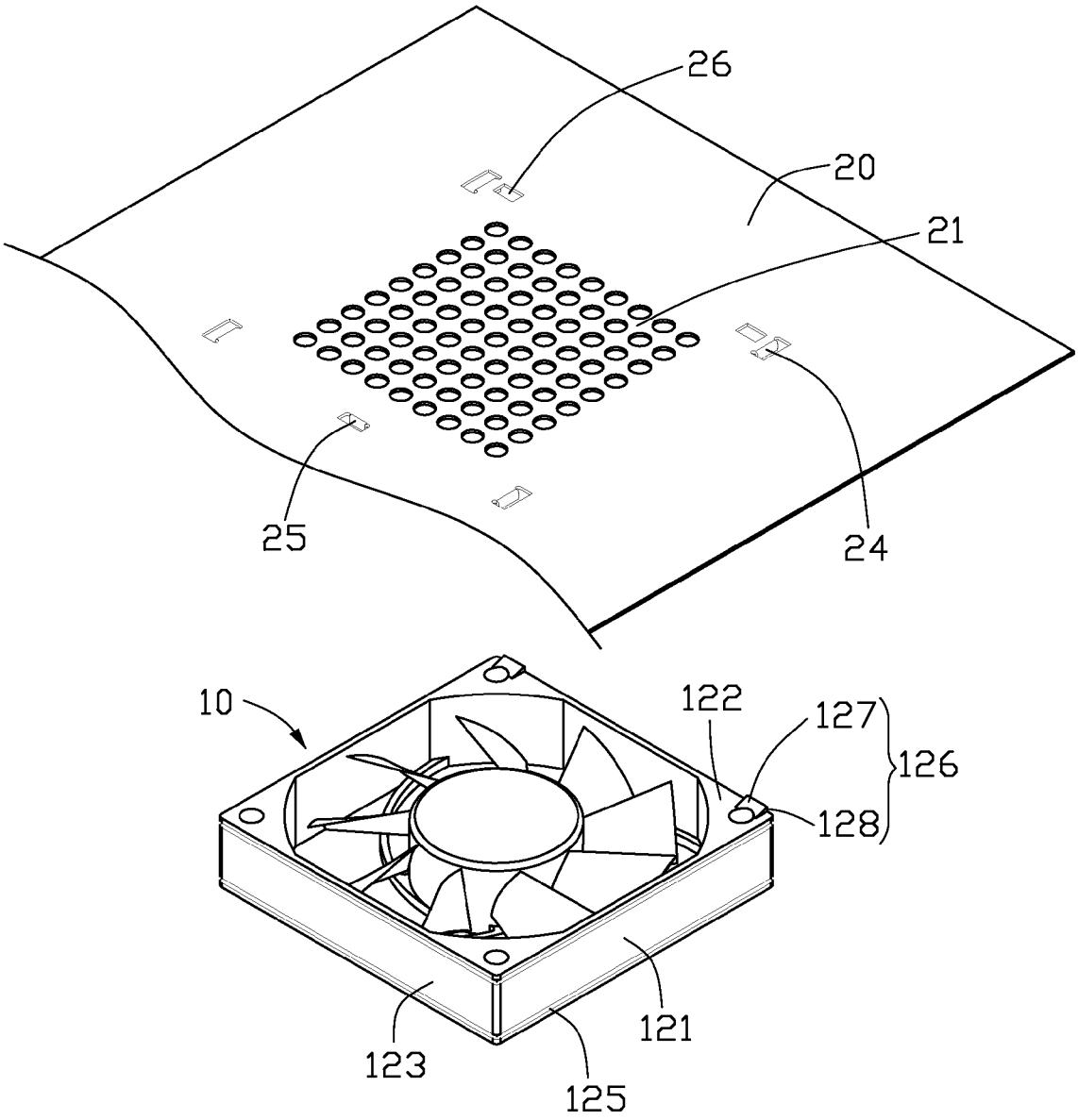

Referring to FIGS. 1 and 2, a first embodiment of a fan device assembly includes a fixing plate 20, and a fan device detachably attached to the fixing plate 20. The fan device is a fan 10. The fan 10 includes a pairs of first sidewalls 121, a pair of second sidewalls 123, and a pair of end walls 122 perpendicularly disposed at the tops and the bottoms of the first sidewalls 121 and the second sidewalls 123. The pair of first sidewalls 121 is perpendicular to the pair of second sidewalls 123. Each of the first sidewalls 121 includes two sliding slots 125 symmetrically defined therein and respectively along the bottom edge and the top edge thereof. A pair of wedged positioning blocks 126 respectively extends from each of the end walls 122, and the wedged positioning blocks 126 are adjacent to the right-hand second sidewall 123. Each of the positioning blocks 126 includes a guiding wall 127 slantingly extending from the corresponding end wall 122, and a positioning wall 128 perpendicular to the corresponding end wall 122.

The fixing plate 20 includes a rectangular ventilation area 21. Two lines of L-shaped hooks 24, which extend perpendicularly from the plate 20 and bend toward each other, are arranged at two opposite first edges of the ventilation area 21, to define a slideway 22 therebetween. Each line includes two hooks 24. A stopping tab 25 and a pair of positioning rectangular holes 26 are disposed at two ends of the railway 22, respectively. The two positioning holes 26 are respectively located beside the corresponding hooks 24 on one of the ends.

Figure 3:
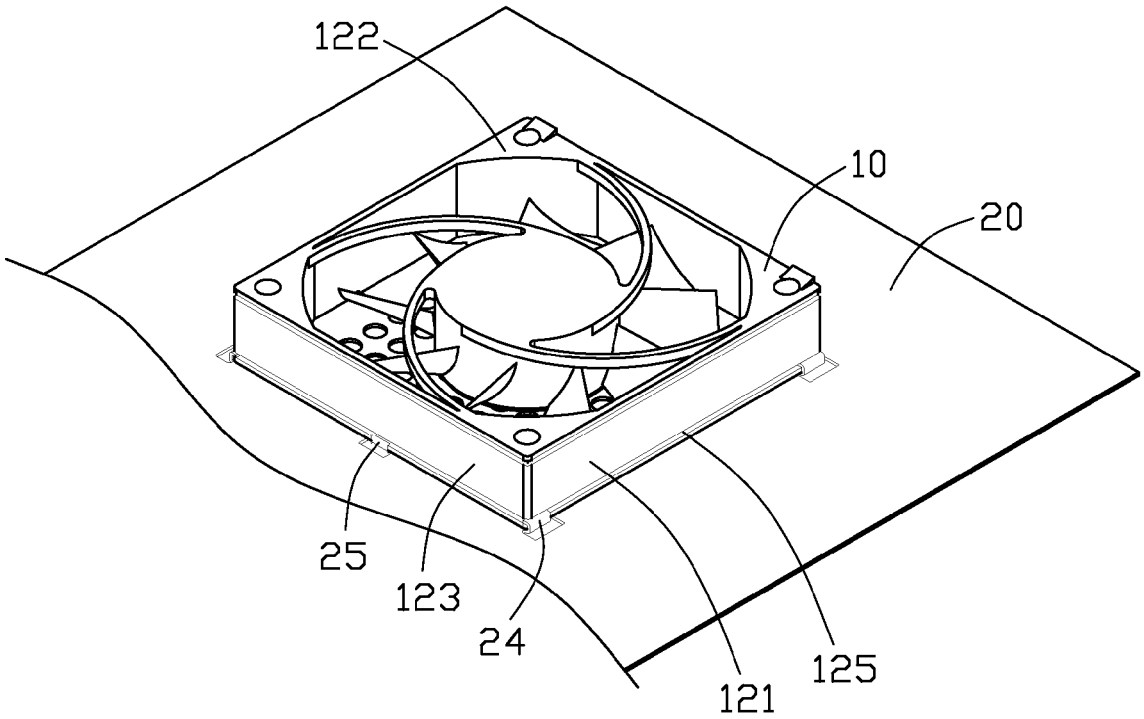
FIG. 3 is an assembled, isometric view of the fan device assembly of FIG. 1.
Figure 4:
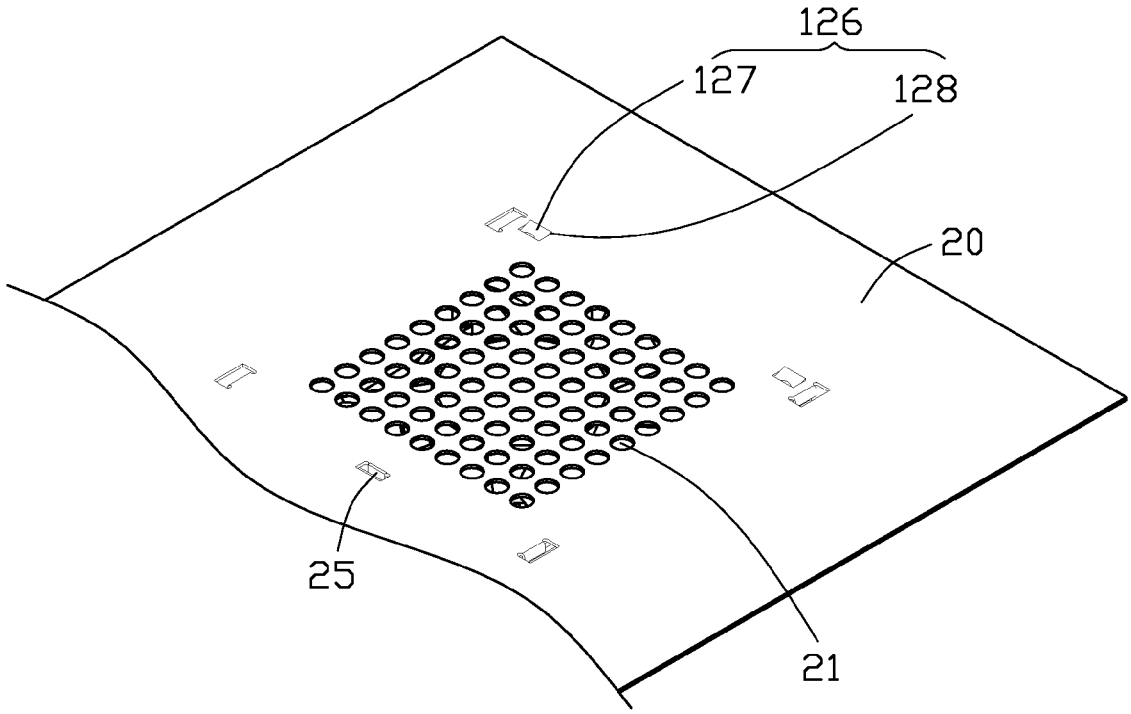
FIG. 4 is an assembled, isometric view of the fan device assembly of FIG. 2.

Referring to FIGS. 3 and 4, in this illustrated embodiment, the bottom end wall 122 is attached to the fixing plate 20 and slidably received in the railway 22, with the hooks 24 slidably engaged in the bottom sliding slots 125 of the first sidewalls 121. One of second sidewalls 123 is stopped by the stopping tab 25 of the fixing plate 20. The positioning blocks 126 on the bottom end wall 122 engage in the positioning holes 26 of the fixing plate 20, with the positioning walls 128 blocked by edges of the rectangular positioning holes 26. Thus, the fan 10 is fixed on the fixing plate 20. In other embodiments, the top end wall 122 of the fan 10 can be slidably attached to the fixing plate 20. To detach the fan 10 from the fixing plate 20, the wedged positioning blocks 126 are pushed out of the positioning holes 26.

Figure 5:
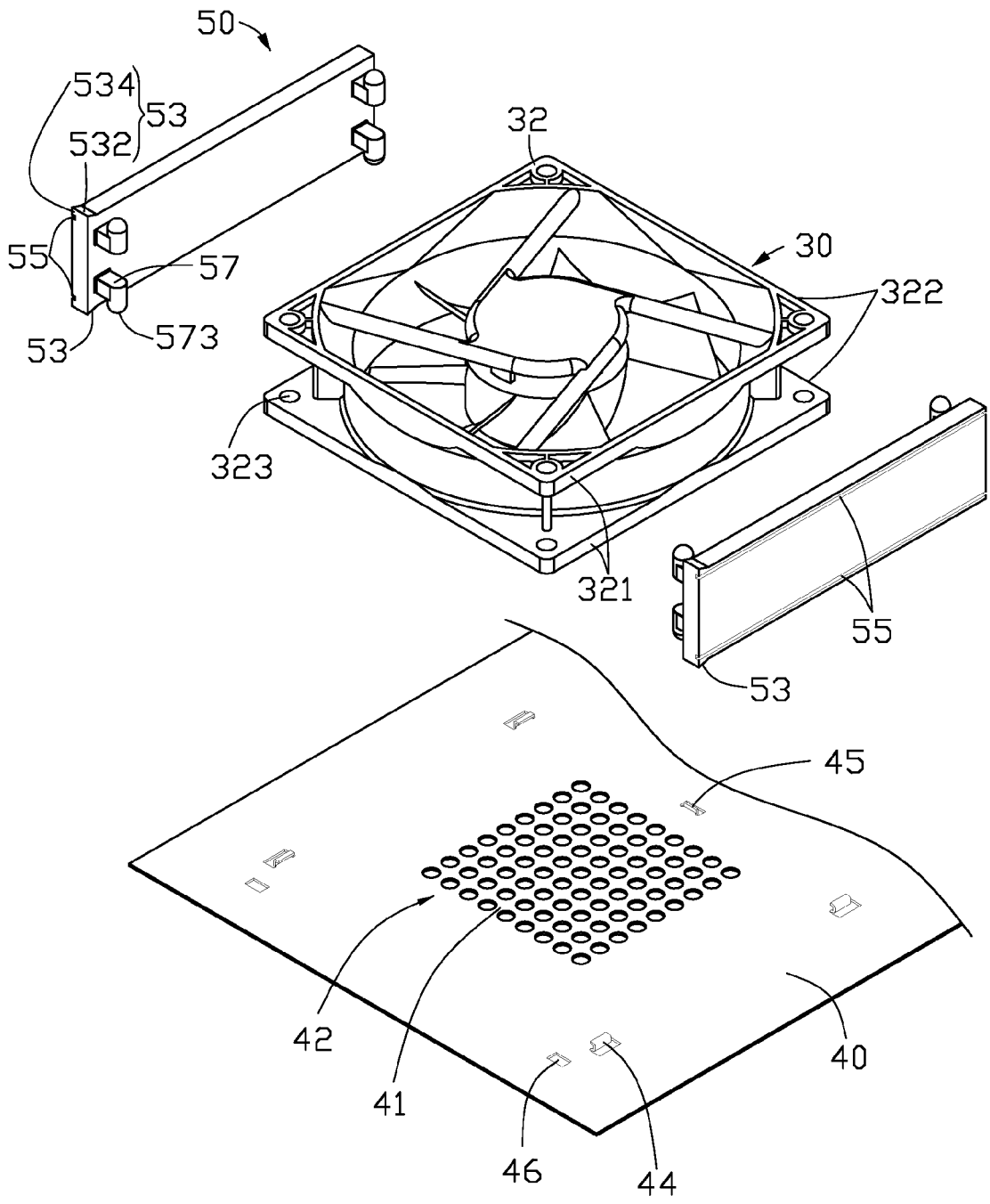
FIG. 5 is an exploded, isometric view of a second embodiment of a fan device assembly.

Referring to FIG. 5, a second embodiment of the fan device assembly includes a fixing plate 40, and a fan device detachably attached to the fixing plate 40. The fan device includes a fan 30, and a pair of mounting sheets 50 attached to the fan 30. The fan 30 includes a pair of spaced rectangular end walls 32 each with a pair of opposite edges 321, and a pair of opposite edges 322 perpendicular to the edges 321. The end walls 32 include a plurality of mounting holes 323 each defined in a corner thereof. Each mounting sheet 50 includes a pair of sliding slots 55 defined in an outside thereof and respectively along the bottom edge and the top edge thereof, a pair of wedged positioning blocks 53 respectively extending from the top and the bottom of the mounting sheet 50 and adjacent to ends of the sliding slots 125 at one same end of the mounting sheet 50, and two pairs of mounting tabs 57 extending from an inside of the mounting sheet 50 from both ends thereof and vertically aligned within each pair. Each pair of vertically aligned mounting tabs 57 includes two posts 573 extending oppositely away from each other. The positioning blocks 53 of each mounting sheet 50 are also located adjacent to ends of the sliding slots 125. Each of the positioning blocks 53 includes a guiding wall 532 slantingly extending from the top or the bottom of the mounting sheet 50, and a positioning wall 534 perpendicular to the top or the bottom of the mounting sheet 50.

The fixing plate 40 is similar to the fixing plate 20 and includes a rectangular ventilation area 41. Two lines of L-shaped hooks 44, which extend perpendicularly from the fixing plate 40 and bend toward each other, are arranged at two opposite first edges of the ventilation area 41, to define a slideway 42 therebetween. Each line includes two hooks 44. A stopping tab 45 and a pair of positioning rectangular holes 46 are disposed along two corresponding ends of the railway 42. The two positioning holes 46 are respectively located beside the corresponding hooks 44 along one of the ends opposite to the stopping tab 45.

In assembly of the fan device of the second embodiment, the two mounting sheets 50 are attached to the fan 30 toward the opposite edges 321 of the end walls 32, with the mounting tabs 57 sandwiched between the two end walls 32 and the posts 573 of the mounting tabs 57 engaging in the mounting holes 323 of end walls 32. The bottoms of the mounting sheets 50 are attached to the fixing plate 40 and slidably received in the railway 42, with the hooks 44 engaging in the bottom sliding slots 53 of the mounting sheets 50. One of the pair of opposite edges 322 of the bottom end wall 32 is stopped by the stopping tab 45. The bottom positioning blocks 53 of the mounting sheets 50 engage in the positioning holes 46 of the fixing plate 40, with the positioning walls 534 blocked by edges of the rectangular positioning holes 46. Thus, the fan device is fixed on the fixing plate 40. In other embodiments, the top of the fan device can be slidably attached to the fixing plate 40. To detach the fan device from the fixing plate 40, the wedged positioning blocks 53 are pushed out of the positioning holes 46.

It is to be understood, however, that even though numerous characteristics and advantages of the embodiments have been set forth in the foregoing description, together with details of the structure and function of the embodiments, the disclosure is illustrative only, and changes may be made in details, especially in matters of shape, size, and arrangement of parts within the principles of the embodiments to the full extent indicated by the broad general meaning of the terms in which the appended claims are expressed.

What is claimed is:

1. A fan device comprising:

a fan comprising a pair of parallel first sidewalls, a pair of parallel second sidewalls perpendicular to the first sidewalls, and a pair of end walls perpendicularly disposed at the top and the bottom of the first and second sidewalls; and a pair of first sliding slots symmetrically and longitudinally defined in the first sidewalls along bottom edges of the first sidewalls, and a first positioning block extending outwards from one of the end walls disposed at the bottom of the first and second sidewalls and located close to one of the second sidewalls.

2. The fan device of claim 1, wherein a pair of second sliding slots are symmetrically and longitudinally defined in the first sidewalls along top edges of the first sidewalls, a second positioning block extends outwards from the other end wall disposed at the top of the first and second sidewalls and adjacent to said one of the second sidewalls.

3. The fan device of claim 2, wherein each of the first and second positioning blocks comprises a guiding wall slantingly extending from the corresponding end wall, and a positioning wall perpendicular to the corresponding end wall.

4. A fan device assembly comprising:

a fan device comprising a pair of sliding slots defined in two opposite sides thereof, and at least one positioning block extending from at least one of the bottom and the top thereof and located close to one same side of the fan device; and a fixing plate for detachably fixing the fan device thereto and comprising a railway for slidably engaging with the sliding slots of the fan device, a stopping tab disposed at one end of the railway to stop the fan device, and at least one positioning hole disposed at the other end of the railway to engage with the at least one positioning block of the fan device.

5. The fan device assembly of claim 4, wherein the fan device comprises a fan, the fan comprises a pair of parallel first sidewalls, a pair of parallel second sidewalls perpendicular to the first sidewalls, and a pair of end walls perpendicularly disposed at the top and the bottom of the first and second sidewalls.

6. The fan device assembly of claim 5, wherein a pair of sliding slots is defined in each of the first sidewalls along the bottom edge and the top edge thereof, a pair of positioning blocks extends from each of the end walls, and the positioning blocks are adjacent one of the second sidewalls.

7. The fan device assembly of claim 6, wherein each of the positioning blocks comprises a guiding wall slantingly extending from the corresponding end wall, and a positioning wall perpendicular to the corresponding end wall.

8. The fan device assembly of claim 4, wherein the fan device comprises a fan, and a pair of mounting sheets attached to two opposite sides of the fan, a pair of sliding slots are defined in an outside of each mounting sheet along the bottom edge and the top edge thereof, two positioning blocks extend from the top and the bottom of each mounting sheets and located at a same end of each mounting sheet.

9. The fan device assembly of claim 8, wherein each of the positioning blocks comprises a guiding wall slantingly extending from the top or the bottom of the corresponding mounting sheet, and a positioning wall perpendicular to the top or the bottom of the corresponding mounting sheet.

10. The fan device assembly of claim 8, wherein the fan comprises two ends walls each defining a plurality of mounting holes in corners thereof, the mounting sheets comprise a plurality of mounting tabs extending from insides thereof, each mounting tab comprises a post extending therefrom to engage in the corresponding mounting hole.

11. The fan device assembly of claim 4, wherein the fixing plate comprises a rectangular ventilation area, the railway is defined by two lines of L-shaped hooks extending from the plate beside two opposite edges of the ventilation area and bending toward each other.

12. The fan device assembly of claim 11, wherein the at least one positioning hole is rectangular and located beside the corresponding hook for engaging with the at least one positioning block.

* * * * *